US010278504B2

(12) United States Patent
Mezzera

(10) Patent No.: US 10,278,504 B2
(45) Date of Patent: May 7, 2019

(54) CABLE CONNECTOR FOR A CHAIR FUNCTION CONTROLLER AND OPERATOR

(71) Applicant: Marcelo Mezzera, Rancho Santa Margarita, CA (US)

(72) Inventor: Marcelo Mezzera, Rancho Santa Margarita, CA (US)

(73) Assignee: Living Style (B.V.I.) Limited (VG)

( * ) Notice: Subject to any disclaimer, the term of this patent is extended or adjusted under 35 U.S.C. 154(b) by 0 days.

(21) Appl. No.: 15/442,052

(22) Filed: Feb. 24, 2017

(65) Prior Publication Data

US 2018/0242743 A1 Aug. 30, 2018

(51) Int. Cl.

| | |
|---|---|
| ***A47C 1/03*** | (2006.01) |
| ***A47C 3/02*** | (2006.01) |
| ***A47C 7/00*** | (2006.01) |
| ***A47C 1/032*** | (2006.01) |
| ***A47C 3/026*** | (2006.01) |
| ***A47C 1/022*** | (2006.01) |
| ***A47C 1/024*** | (2006.01) |
| ***A47C 3/30*** | (2006.01) |

(52) U.S. Cl.

CPC ..... *A47C 1/03205* (2013.01); *A47C 1/022* (2013.01); *A47C 1/0248* (2013.01); *A47C 1/03216* (2013.01); *A47C 1/03255* (2013.01); *A47C 3/026* (2013.01); *A47C 3/30* (2013.01); *A47C 7/004* (2013.01)

(58) Field of Classification Search

CPC ..... A47C 1/0244; A47C 1/03216; A47C 1/03255; A47C 3/026; A47C 3/20; A47C 3/30; A47C 7/004; A47C 7/465; A47C 7/467; A61G 2203/00; A61G 2203/10

See application file for complete search history.

(56) References Cited

U.S. PATENT DOCUMENTS 4,480,720 A * 11/1984 Shimano ..... B62L 3/08 188/2 D
5,080,434 A * 1/1992 Locher ..... A47C 1/03216 297/300.3
5,138,898 A * 8/1992 Pospisil ..... F16C 1/101 74/502.6
5,671,972 A * 9/1997 Tedesco ..... A47C 3/30 297/361.1

(Continued)

FOREIGN PATENT DOCUMENTS

JP 2007045280 A * 2/2007

*Primary Examiner* — Ryan D Kwiecinski
(74) *Attorney, Agent, or Firm* — Morland C. Fischer

(57) ABSTRACT

Disclosed herein is a chair of the kind that is shipped to a user disassembled. The chair includes at least one chair function controller (i.e., a paddle) that is actuated to control a chair function operator (e.g., a gas cylinder located below and coupled to the chair seat). During assembly, a pair of cable sections are mechanically and serially connected to one another at a force responsive connector block that is located within and slidable through a cable connector housing at the bottom of the chair seat. By virtue of connecting the first and second cables together at the connector block, the chair function controller paddle is connected to the chair function operator so that an actuation of the controller causes a pulling force to be applied to the chair function operator to enable the seat or back of the chair to be displaced.

6 Claims, 3 Drawing Sheets

(56) References Cited

U.S. PATENT DOCUMENTS

| | | | | | |
|---|---|---|---|---|---|
| 5,775,764 | A * | 7/1998 | Yamashita | E05B 79/20 | 296/76 |
| 5,829,314 | A * | 11/1998 | Scura | B60T 11/06 | 74/502.4 |
| 6,085,611 | A * | 7/2000 | Valdez | B62L 1/00 | 74/501.6 |
| 7,469,617 | B2 * | 12/2008 | Basile | F16C 1/22 | 74/501.5 R |
| 8,857,288 | B2 * | 10/2014 | Sano | F16C 1/101 | 74/502.4 |
| 9,090,308 | B2 * | 7/2015 | Chiang | B62L 3/08 | |
| 2003/0227203 | A1 * | 12/2003 | Mundell | A47C 7/465 | 297/284.4 |
| 2011/0239810 | A1 * | 10/2011 | Wu | A47C 1/023 | 74/502.2 |

* cited by examiner

CABLE CONNECTOR FOR A CHAIR FUNCTION CONTROLLER AND OPERATOR

BACKGROUND OF THE INVENTION

1. Field of the Invention

This invention relates to a chair of the kind that is preferably shipped disassembled to the end user in a compact container. The chair includes one or more chair function controllers (i.e., paddles) that are actuated by the user of the chair to control functions of the chair (e.g., seat elevation and/or backwards tilt). During assembly, pairs of cable sections are mechanically and serially connected to one another at respective cable connector housings located below the chair seat by which the chair function controller paddles are connected to chair function operators to enable the user to control the functions of the chair.

2. Background Art

Large pieces of furniture, such as chairs and sofas, are typically shipped from a location of manufacture to a location of sale and finally to the public for use. The large and bulky nature of this furniture contributes to the purchase price paid by consumers. That is to say, as a consequence of its space-consuming size, relatively large shipping vessels are required to move the furniture from place to place. Moreover, relatively large storage facilities are necessary to accommodate the furniture while in transit from location-to-location. To overcome this problem, some articles of furniture (e.g., chairs) have been shipped disassembled in a space efficient container so that the final assembly can be completed by the end user.

One type of chair that has been shipped in a disassembled configuration with the back and seat separated from one another is that having one or more chair function controllers (sometimes referred to as paddles) which are actuated by a user of the chair to control the operation of the chair (e.g., causing the seat of the chair to be elevated or enabling the back of the chair to tilt backwards). Prior to assembly of the chair, the chair function controller paddles are disconnected and located remotely from the chair function operators. Therefore, it would be desirable to have a reliable means of connection by which cables coupled to the chair function controller paddles at one location of the chair and cables coupled to the chair function operators at another location can be mechanically and serially connected to one another during assembly of the chair without the use of tools.

SUMMARY OF THE INVENTION

In general terms a chair is disclosed of the kind that is preferably shipped in a compact container to be assembled by the end user without the use of tools. The chair includes a seat to support the weight of a user, a base to hold the seat above the ground, a back connected to and standing upwardly from the seat, a pair of arms located at opposite sides of the seat, and a gas cylinder located below the seat by which to enable the user to adjust the elevation of the seat. The chair also includes one or more chair function controllers (referred to herein as paddles) that are accessible to the user at respective ones of the pair of arms. By way of example, one chair function controller (e.g., a height control paddle) is coupled by means of serially connected first and second height control cable sections to the gas cylinder located below the chair seat. When the user actuates the height control paddle, a pulling force is applied to the first and second height control cable sections to cause a piston to be released by the gas cylinder to thereby adjust the elevation of the chair seat above the base. By way of another example, a different chair function controller (e.g., a tilt control paddle) is coupled by means of serially connected first and second tilt control cable sections to a locking pin that holds the chair back upright. When the user actuates the tilt control paddle, a pulling force is applied to the first and second tilt control cable sections to release the locking pin and thereby enable the back and seat of the chair to tilt backwards when the user leans back.

The pairs of first and second height control and tilt control cable sections are initially separated and disconnected from one another when the chair is shipped disassembled. During assembly of the chair, each pair of first and second cable sections is mechanically and serially connected to one another within a respective cable connector housing lying at the bottom of the chair seat. Each cable connector housing includes a force responsive connector block that is slidable through a cable guide channel that runs longitudinally through the housing. One end of a first cable section is connected to a chair function controller paddle. The opposite end of the first cable section terminates at a first locking plug which is received within a first locking plug cavity of the connector block. One end of a second cable section is connected to a chair function operator (e.g., the gas cylinder lying below the chair seat). The opposite end of the second cable section terminates at a second locking plug which is received within a second locking plug cavity of the connector block, whereby the first and second cable sections are mechanically and serially connected to one another.

Accordingly, when one who is seated in the chair actuates a chair function controller paddle at one of the chair arms, a pulling force is applied to the first cable section which causes the force responsive connector block to slide through the cable guide channel of the cable connector housing. The pulling force is correspondingly transmitted from the connector block to the second cable section which in turn applies the pulling force to the chair function operator to thereby control a function of the chair.

DESCRIPTION OF THE PREFERRED EMBODIMENT

Figure 1:
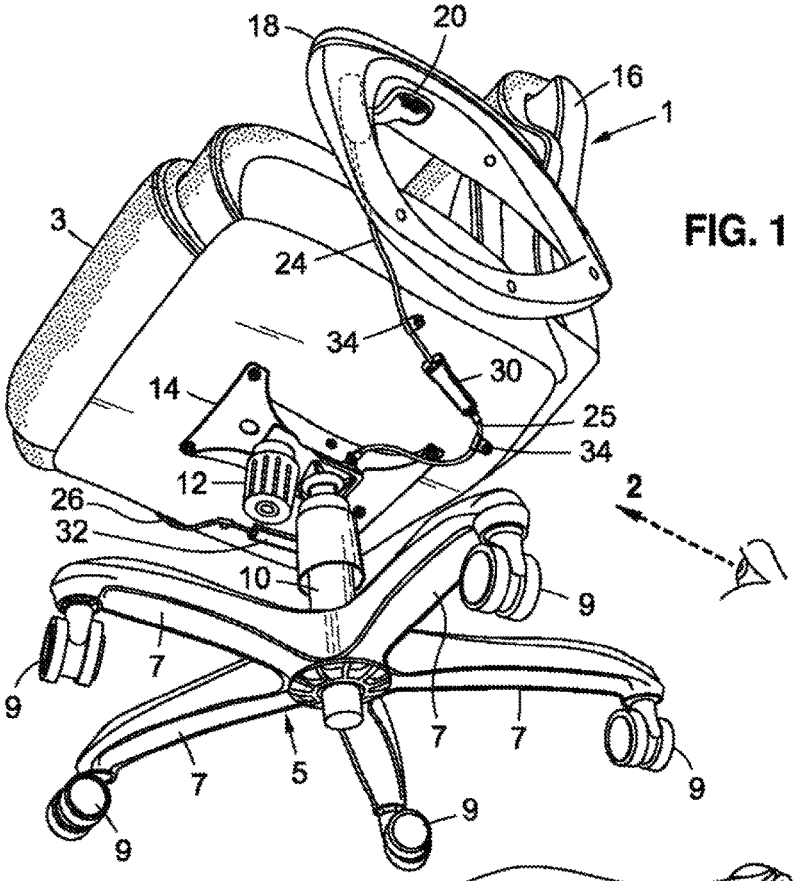
FIG. 1 shows a chair having pairs of first and second cable sections being mechanically and serially connected to one another by means of respective cable connector housings positioned at the bottom of the chair seat to enable functions of the chair to be controlled by one who is seated in the chair.
Figure 2:
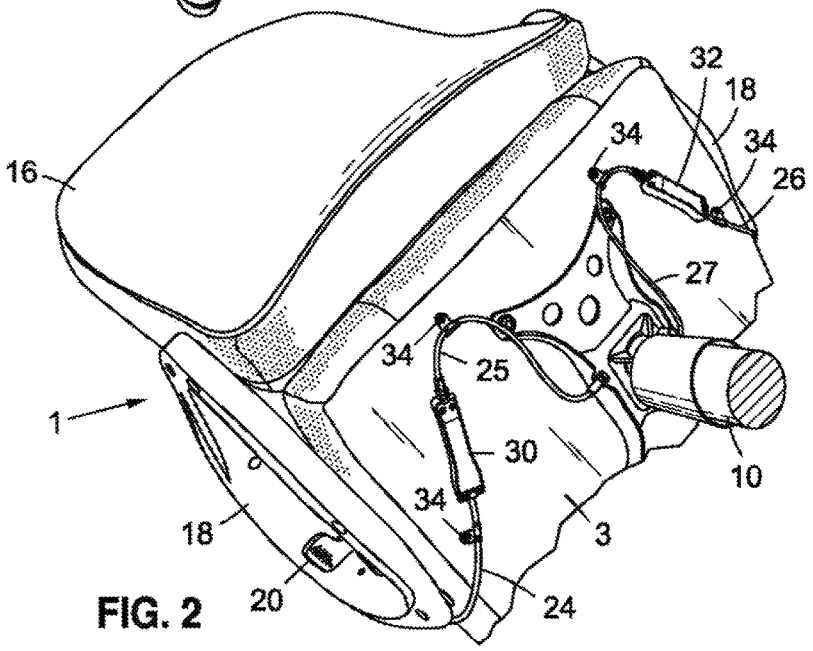
FIG. 2 is an enlarged detail showing the bottom of the seat of the chair of FIG. 1 with the pairs of first and second cable sections being connected to one another within respective cable connector housings.

Referring initially to FIGS. 1 and 2 of the drawings, there is shown a chair 1 of the kind that would typically be found in a home or office. The chair 1 is preferably shipped disassembled to be subsequently assembled by the end user without having to use tools. However, it is to be understood that the advantages of this invention are also applicable to other kinds of chairs which are already assembled when shipped.

The chair shown in FIGS. 1 and 2 includes a seat 3 to support the weight of a user. The seat 3 is held above the ground by a base 5 having a set of outstretched legs 7 to which respective rollers 9 are attached to permit the chair 1 to be moved from place-to-place. A conventional gas filled cylinder 10 extends between the base 5 and the bottom of the seat 3. When the gas cylinder 10 is activated in a manner to be explained below, the elevation of the seat 3 relative to the base 5 can be adjusted to suit the needs of the user. A conventional tension adjustment knob 12 is accessible below a seat plate 14 that is attached to the bottom of the seat 3 at which to surround and support both the gas cylinder 10 and the tension adjustment knob 12. The user of the chair 1 can rotate the tension adjustment knob 12 to adjust the spring tension of the seat 3 depending upon the user's size and weight.

The chair 1 also includes a back 16 that is connected to and stands upwardly from the seat 3. The back 16 and seat 3 are adapted to tilt back and forth with one another as the user shifts his weight in the chair 1. A pair of arms 18 are located at opposite sides of the seat 3. First ends of the arms 18 are connected to the seat 3, while the opposite ends of the arms 18 are connected to the back 16 to support the arms of the user. When the chair is shipped disassembled, the seat 3, back 16 and arms 18 are often separated from one another.

User actuated height and tilt function controllers (commonly known in the trade as paddles) are shown located on the arms 18 of the chair 1 so as to be readily accessible to the user seated on the seat 3. The chair function control paddles (only one of which 20 being shown) enable the user to selectively control the elevation of the seat 3 above the chair base 5 as well as the ability of the seat 3 and back 16 to tilt backwards to enhance the user's comfort. However, it is to be understood that the chair functions to be controlled by the chair function control paddles are not limited to those referred to above.

The height and tilt control paddles are identical to one another and can be the same as the chair function control paddles described in patent application Ser. No. 15/230,925 filed Aug. 8, 2016, the details of which are incorporated herein by reference. Therefore, only a brief description of one chair function control paddle (e.g., 20) will be provided below. The height control paddle 20 is connected by way of a pair of serially connected height control cable sections 24 and 25 to the gas cylinder 10. Actuating (i.e., rotating a rotatable drum of) the height control paddle 20 causes a plunger (not shown) of the gas cylinder 10 to be forced under pressure outwardly from cylinder 10 and towards the chair seat 3 by which to correspondingly change the elevation of the seat 3 below which the gas cylinder is connected. The tilt control paddle (not shown) is connected by way of a pair of serially connected tilt control cable sections 26 and 27 to a conventional tilt control locking pin (not shown) that is covered by the seat plate 14. Actuating (i.e., rotating a rotatable drum of) the tilt control paddle applies a pulling force to the tilt control locking pin to temporarily unlock the seat 3 and back 16 of the chair 1 from their normally stationary position so as to enable the seat and back to tilt backwards with one another relative to the chair base 5 when the user leans against the chair back 16.

A first cable connector housing 30 is positioned at the bottom of the chair seat 3 to connect the first and second cable sections 24 and 25 to one another so that an actuation of the height control paddle 20 located at one of the chair arms 18 will cause the gas cylinder 10 to be actuated and the elevation of the seat 3 to be adjusted relative to the base 5. A second cable connector housing 32 is also positioned at the bottom of the chair seat 3 to connect the first and second cable sections 30 and 32 to one another so that an actuation of the tilt control paddle located at the other chair arm 18 will permit the back 16 and seat 3 of the chair 1 to be unlocked and tilted backwards with one another.

Each cable section of each of the pairs of first and second height control and tilt control cable sections 24, 25 and 26, 27 is snapped into a cable retaining clip 34, and the cable retaining clips 34 are attached to the bottom of the seat 3 of the chair 1. However, prior to the assembly of the chair 1, when the chair arms 18 are separated from the chair seat 3, each of the first cable sections 24 and 26 simply dangle freely from the chair arms 18 at which the paddle controllers (e.g., 20) are located. Each of the second cable sections 25 and 27 is preferably connected prior to assembly of the chair to a respective cable connector housing 30 or 32 that is positioned at the bottom of the chair seat 3.

The ability of the manufacturer to initially detach the pairs of first and second cable sections 24, 25 and 26, 27 from one another facilitates the disassembly and shipment of the no tools chair 1 in compact shipping containers with the seat 3, back 16 and arms 18 disconnected from one another. The aforementioned cable connector housings 30 and 32 enable the user to mechanically connect the first and second cable sections 24, 25 and 26, 27 together during assembly of the chair 1 so that a pulling force applied to the first cable sections 24 and 26 by actuating the height and tilt control paddles (e.g., 20) will be transferred to the second cable sections 25 and 27, whereby to control different functions of the chair 1.

Figure 3:
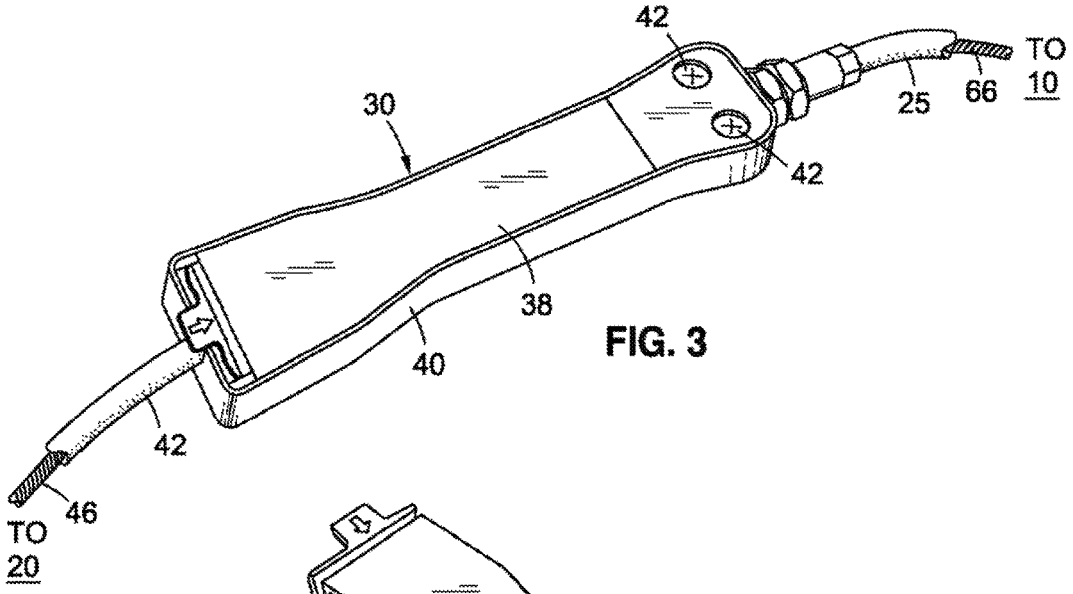
FIG. 3 shows one of the cable connector housings of FIGS. 1 and 2 with a cover attached thereto.
Figure 4:
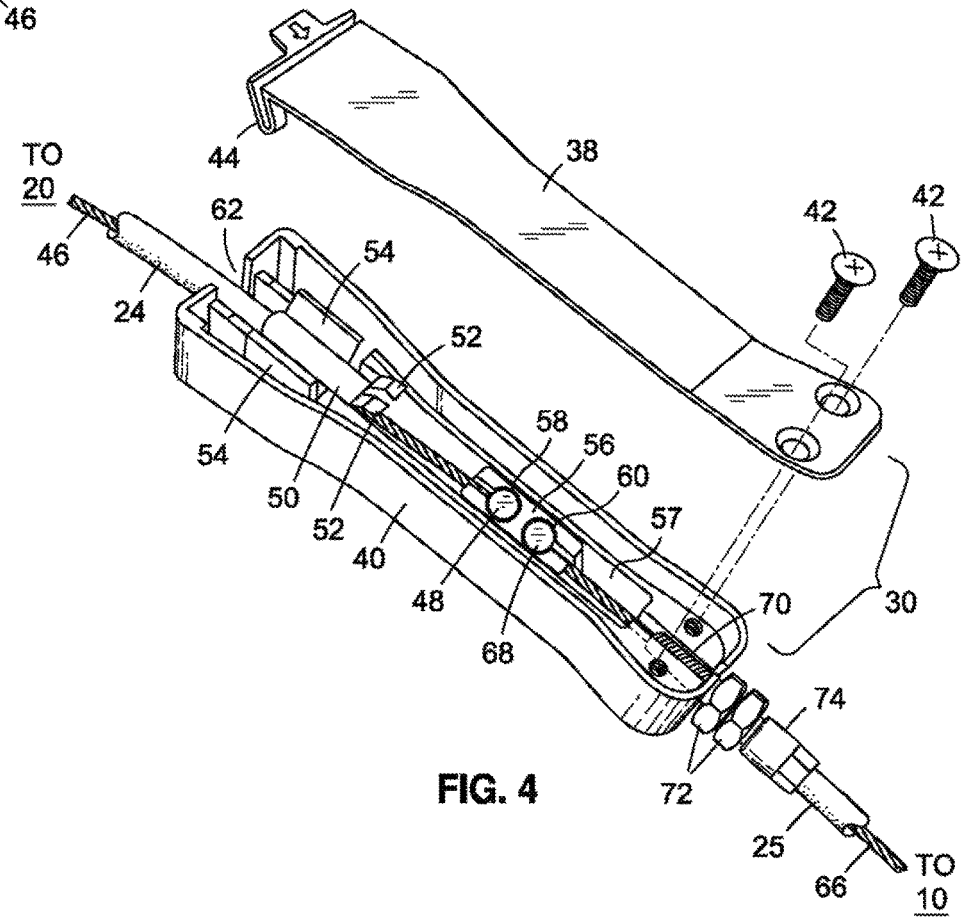
FIG. 4 shows the cable connector housing of FIG. 3 with the cover removed to illustrate one pair of first and second cable sections being mechanically and serially connected to one another within the housing.

Referring to FIGS. 3 and 4 of the drawings, the details are now provided for making the mechanical connection of the pairs of first and second cable sections 24, 25 and 26, 27 by means of respective cable connector housings 30 and 32. For the purpose of illustration, only a single cable connector housing (e.g., 30) for mechanically and serially connecting together a single pair of first and second cable sections (e.g., 24 and 25) for performing one of the aforementioned chair functions (e.g., adjusting the seat elevation) will be described below.

The cable connector housing 30 includes a removable cover 38 which is detachable connected to a rectangular base 40 within which the first and second cable sections 24 and 25 are received and serially connected to one another. One end of the cover 38 is connected to the base 30 by means of fasteners (e.g., screws) 42 extending therebetween, and the opposite end of cover 38 has a pair of feet (only one of which 44 being shown in FIG. 4) that depend therefrom to be received inwardly of the base 40.

The first cable section 24 includes an outer sheath that surrounds an inner metallic cable core 46. A first end of the cable core 46 is connected to the height control paddle 20 located at one of the arms 18 of the chair 1 of FIG. 1. The opposite end of the cable core 46 terminates at a cylindrical locking plug 48. A relatively wide cylindrical locking sleeve 50 surrounds the first cable section 24 adjacent the locking plug 48 so that both the locking plug 48 and the locking sleeve 50 can be received within the base 40 of the cable connector housing 30. A pair of cable guide tabs 52 project from the locking sleeve 50 towards the locking plug 48 at the first end of the inner cable core 46.

A pair of spaced, parallel aligned locking sleeve retaining walls 54 stand upwardly from the base 40 at a first end of the cable connector housing 30 within which the first cable section 24 is to be located. Positioned within the rectangular base 40 of the cable connector housing 30 is a force responsive connector block 56. As will be explained when referring to FIGS. 5 and 6, the connector block 56 is adapted to slide back and forth through a cable guide channel 57 which extends longitudinally through the base 40 of housing 30 depending upon whether the chair function control paddles (e.g., 20) are being actuated by one sitting in the chair 1 of FIG. 1. A pair of cylindrical locking plug cavities 58 and 60 are formed opposite one another within connector block 56.

During the assembly of the chair 1, the first cable section 24 is connected to the base 40 at the first end of housing 30. To accomplish the foregoing, with the cover 38 removed from the base 40, the first cable section 24 is moved by the user inwardly of the cable connector housing 30 through an opening 62 formed in the base 40 (best shown in FIG. 4). The locking sleeve 50 which surrounds cable section 24 is then press fit and retained between the pair of locking sleeve retaining walls 54, and the cylindrical locking plug 48 carried by the inner cable core 46 of cable section 24 is press fit and retained within the cylindrical locking plug cavity 58 formed in the sliding connector block 56.

The second cable section 25 which is preferably located within the cable connector housing 30 prior to assembly of the chair 1 also includes an outer sheath that surrounds an inner metallic cable core 66. In the example shown in FIG. 4, one end of the cable core 66 is connected to the plunger of the gas filled cylinder 10 (of FIGS. 1 and 2) which lies below the seat 3 of chair 1. The opposite end of the cable core 66 of cable section 25 terminates at a cylindrical locking plug 68 that is identical to the locking plug 48 carried by the inner cable core 46 of the first cable section 24. The cylindrical locking plug 68 carried by the inner cable core 66 is initially press fit and retained within the cylindrical locking plug cavity 60 that is formed in the force responsive connector block 56 opposite the locking plug cavity 58 and the locking plug 48 received therein.

A threaded cylindrical coupler 70 surrounds the second cable section 25 adjacent the locking plug 68 so that both the locking plug 68 and a portion of the threaded coupler 70 are received within the base 40 at the end of the cable connector housing 30 which lies opposite the end thereof at which the first cable section 24 is received. A pair of threaded adjustment nuts 72 surround the threaded coupler 70 at a portion thereof which extends outside the base 40. In the assembled housing configured, the adjustment nuts 72 lie outside the housing 30 between the base 40 and a relatively wide nut retainer 74 that surrounds the second cable section 25 outside housing 30.

With the locking plug 68 of the cable core 66 captured by the locking plug cavity 60 formed in the connector block 56, the first and second cable sections 24 and 25 which lie adjacent the bottom of the chair seat 3 are mechanically connected in series with one another within the cable connector housing 30 so that a pulling force generated when one seated in the chair 1 rotates the rotatable drum of the height control paddle 20 is transmitted by way of the serially connected cable cores 46 and 66 to the gas cylinder 10 lying below the chair seat 3 of FIGS. 1 and 2, whereby the elevation of the seat 3 can be selectively adjusted. As indicated above, the first and second cable sections 26 and 27 lying adjacent the bottom of the chair seat 3 are also serially and mechanically connected to one another within the other cable connector housing 32 in the same manner as that just described for cable sections 24 and 25. The threaded adjustment nuts 72 which surround the threaded coupler 70 can be loosened and rotated when it is necessary to relocate the coupler 70 within the housing 30 to correspondingly adjust the tension of the cable core 66 and the length of the second cable section 25.

Figure 5:
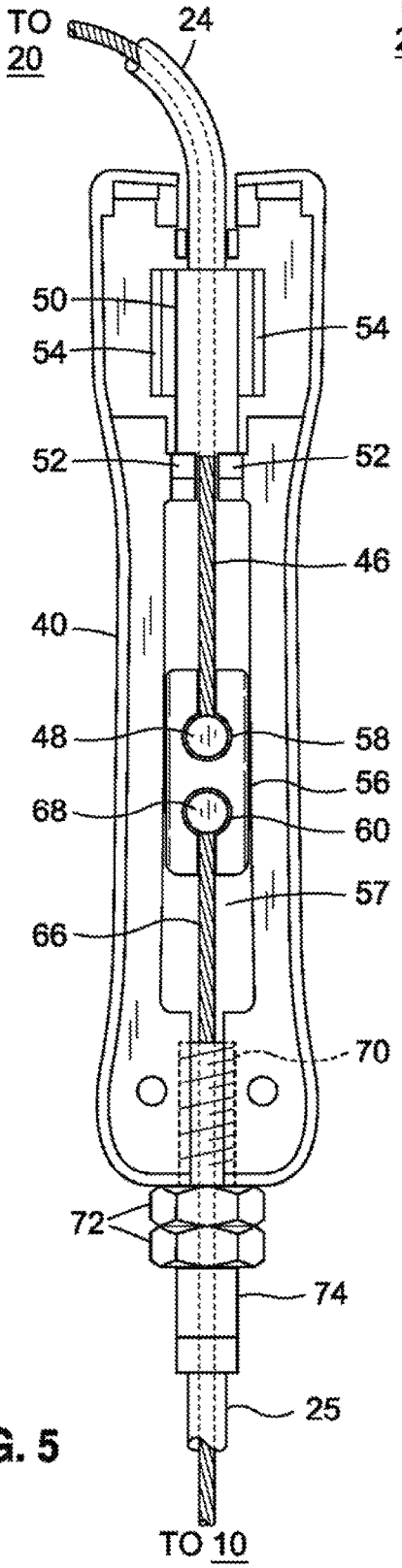
FIG. 5 shows a force responsive connector block to which the first and second cable sections are connected lying at rest within the cable connector housing of FIG. 4 when no pulling force is applied to the first and second cable sections.
Figure 6:
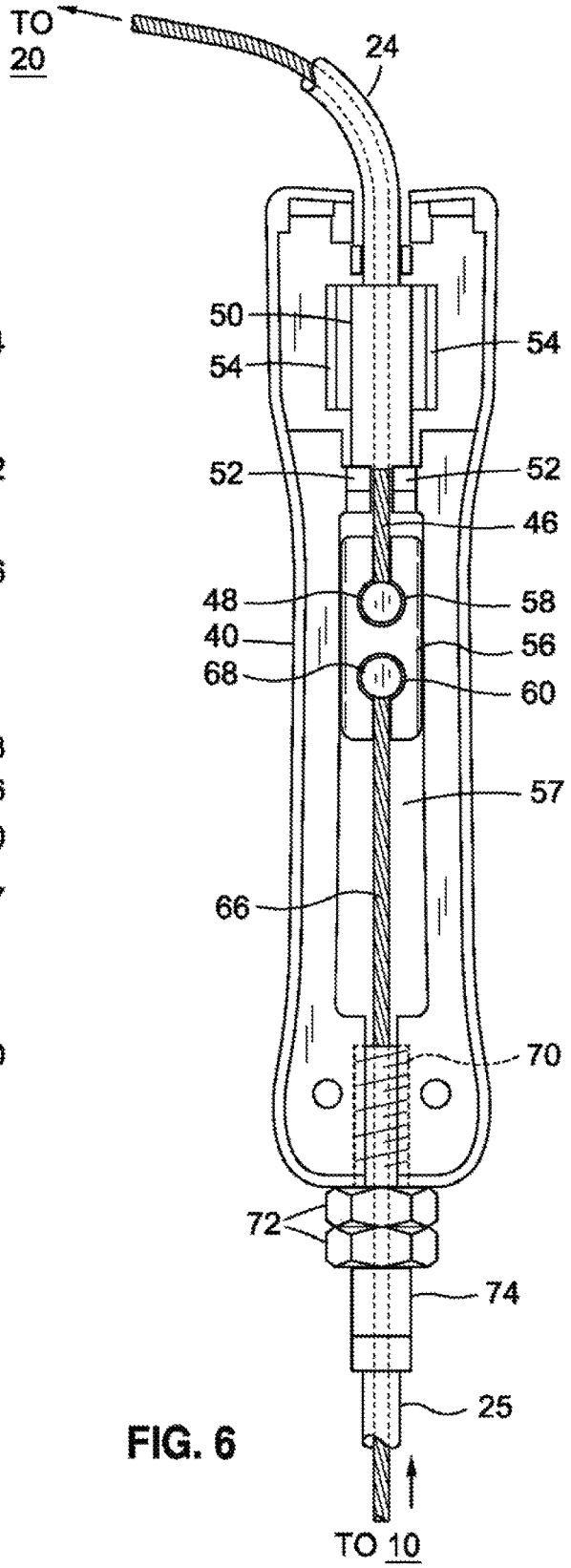
FIG. 6 shows the force responsive connector block sliding through the cable connector housing of FIG. 4 after a pulling force is applied to one of the first and second cable sections by which to control a function of the chair.

FIGS. 5 and 6 of the drawings illustrate the positions of the sliding force responsive connector block 56 within the cable guide channel 57 of the cable connector housing 30 before and after the height control paddle 20 at the front of the chair 1 of FIGS. 1 and 2 is actuated by one seated on the chair seat 3. In FIG. 5, the height control paddle 20 is not actuated, no pulling force is applied to the inner cable core 46 of the first cable section 24 connected to the height control paddle 20, and the connector block 56 lies at its at-rest position approximately midway within the cable guide channel 57 which runs longitudinally through housing 30.

In the case of FIG. 6, the height control paddle 20 is now actuated. Accordingly, a pulling force generated by paddle 20 is applied to the inner cable core 46 of the first cable section 24. Inasmuch as the cable core 46 is connected to the force responsive connector block 56 by means of the locking plug 48, the connector block 56 is pulled through the cable guide channel 57 in the direction of the pulling force (represented by the directional arrows shown in FIG. 6). Because the cable core 66 of the second cable section 25 is connected to connector block 56 by means of the locking plug 68, a corresponding pulling force is applied from connector block 56 to the cable core 66. Thus, the force responsive connector block 56 slides through the cable guide channel 57, and the cable core 66 transfers the pulling force applied thereto from the connector block 56 to the gas cylinder 10 located below the seat 3 of the chair 1 shown in FIGS. 1 and 2 by which to actuate the gas cylinder and adjust the elevation of seat 3.

The invention claimed is:

1. A chair, comprising:

a seat to support the weight of a user;

a back standing upwardly from said seat;

a pair of arms located at opposite sides of said seat;

a chair function controller;

a chair function operator being coupled to one of the seat or the back of the chair and responsive to an actuation of the chair function controller to enable a displacement of the chair seat or the chair back;

a first cable having first and opposite ends, the first end thereof connected to said chair function controller;

a second cable having first and opposite ends, the first end thereof connected to said chair function operator; and a coupler to which the opposite ends of said first and second cables are connected so that said chair function controller is coupled to said chair function operator by way of said first and second cables, whereby said chair seat or said chair back is displaced when said chair function controller is actuated, said coupler having first and second locking cavities formed therein;

locking plugs located at the respective opposite ends of said first and second cables, said locking plugs being received within respective ones of the first and second locking cavities formed in said coupler, whereby said first and second cables are mechanically connected to one another at said coupler; and a housing, said coupler being received within and slidable through said housing to cause said chair seat or said chair back to be displaced when said chair function controller is actuated, wherein the opposite end of said first cable is surrounded by a locking sleeve and said housing includes a pair of locking sleeve retention walls being spaced from one another, the locking sleeve surrounding the opposite end of said first cable being received between and retained by said pair of locking sleeve retainment walls when the locking plug at the opposite end of said first cable is received within a respective one of said first and second locking cavities formed in said coupler.

2. The chair recited in claim 1, wherein said chair function operator is a gas filled cylinder connected to the seat of the chair to adjust the elevation of said seat above the ground when said chair function controller is actuated.

3. The chair recited in claim 1, wherein said chair function controller is located on one of the pair of arms of said chair.

4. The chair recited in claim 1, wherein said coupler is located below the seat of said chair.

5. The chair recited in claim 4, wherein said housing lies adjacent the bottom of the seat of said chair.

6. The chair recited in claim 1, further comprising a threaded cylindrical coupler surrounding the opposite end of said second cable and extending from the inside of said housing to the outside thereof; and a threaded fastener located outside said housing and surrounding said threaded cylindrical coupler, said threaded cylindrical fastener rotating around said threaded cylindrical coupler to tighten said second cable between said locking plug thereof and said chair function operator.

* * * * *